US008410035B2

(12) United States Patent
Kaneshige et al.

(10) Patent No.: US 8,410,035 B2
(45) Date of Patent: Apr. 2, 2013

(54) VISCOSITY MODIFIER OF LUBRICATING OIL FOR POWER TRANSMISSION SYSTEM AND LUBRICATING OIL COMPOSITION FOR POWER TRANSMISSION SYSTEM

(75) Inventors: Ryousuke Kaneshige, Kisarazu (JP); Akihiro Matsuda, Ichihara (JP); Satoshi Ikeda, Ichihara (JP); Keiji Okada, Ichihara (JP); Masaaki Kawasaki, Ichihara (JP)

(73) Assignees: Mitsui Chemicals, Inc., Tokyo (JP); The Lubrizol Corporation, Wickliffe, OH (US)

( * ) Notice: Subject to any disclaimer, the term of this patent is extended or adjusted under 35 U.S.C. 154(b) by 772 days.

(21) Appl. No.: 11/886,960

(22) PCT Filed: Mar. 24, 2006

(86) PCT No.: PCT/JP2006/306015

§ 371 (c)(1),
(2), (4) Date: Dec. 18, 2007

(87) PCT Pub. No.: WO2006/101206

PCT Pub. Date: Sep. 28, 2006

(65) Prior Publication Data

US 2009/0023619 A1 Jan. 22, 2009

(30) Foreign Application Priority Data

Mar. 25, 2005 (JP) ..... 2005-089004

(51) Int. Cl.
*C10M 119/02* (2006.01)
*C08F 10/06* (2006.01)

(52) U.S. Cl. ..... 508/591; 508/473; 526/348

(58) Field of Classification Search ..... 508/473, 508/591; 526/348
See application file for complete search history.

(56) References Cited

U.S. PATENT DOCUMENTS

| | | | | |
|---|---|---|---|---|
| 5,696,214 | A | 12/1997 | Sagane et al. | |
| 6,187,725 | B1 * | 2/2001 | Kramer et al. | 508/469 |
| 6,255,546 | B1 * | 7/2001 | Alexander | 585/1 |
| 7,402,235 | B2 | 7/2008 | Huang | |
| 2003/0073785 | A1 | 4/2003 | Okada et al. | |
| 2004/0058830 | A1 * | 3/2004 | Kan et al. | 508/591 |

FOREIGN PATENT DOCUMENTS

| | | | | |
|---|---|---|---|---|
| EP | 0 718 325 | A2 | | 6/1996 |
| EP | 1148115 | A1 | * | 10/2001 |
| EP | 1 262 498 | A2 | | 12/2002 |
| EP | 1300458 | A1 | * | 4/2003 |
| JP | 07-150181 | | | 6/1995 |
| JP | 2001002731 | A | * | 1/2001 |
| JP | 2005-307099 | | | 11/2005 |
| JP | 2005307099 | A | * | 11/2005 |
| WO | WO 98/33872 | | | 8/1998 |
| WO | WO 00/34420 | | | 6/2000 |
| WO | WO 00/60032 | | | 10/2000 |
| WO | WO 01/59038 | A1 | | 8/2001 |
| WO | WO 01/59042 | A1 | | 8/2001 |
| WO | WO 01/85880 | A1 | | 11/2001 |
| WO | WO-02/10276 | A2 | | 2/2002 |
| WO | WO 03/038017 | A1 | | 5/2003 |

OTHER PUBLICATIONS

Communication (Supplementary EP Search Report) in EP Appln No. 06 72 9963.6 dated Jan. 19, 2012.

* cited by examiner

*Primary Examiner* — Pamela H Weiss
(74) *Attorney, Agent, or Firm* — Foley & Lardner LLP

(57) ABSTRACT

A lubricating oil composition for a power transmission system, which is excellent in both of low-temperature viscosity property and shear stability, is provided. The viscosity modifier of a lubricating oil for a power transmission system according to the present invention comprises an ethylene/α-olefin copolymer (B) having the properties: (B1) an ethylene content in the range of 70 to 85% by mol, (B2) an intrinsic viscosity [η] in the range of 0.2 to 1.0 dl/g, (B3) Mw/Mn not more than 2.4, and (B4) a melting point, as measured by DSC, not higher than 60° C., or no melting point observed.

5 Claims, No Drawings

VISCOSITY MODIFIER OF LUBRICATING OIL FOR POWER TRANSMISSION SYSTEM AND LUBRICATING OIL COMPOSITION FOR POWER TRANSMISSION SYSTEM

TECHNICAL FIELD

The present invention relates to a viscosity modifier of a lubricating oil for power transmission system and a lubricating oil composition for power transmission system, and more particularly, to a viscosity modifier that produces a lubricating oil composition for power transmission system excellent in shear stability and economical efficiency, and to the lubricating oil composition for power transmission system excellent in shear stability and economical efficiency.

BACKGROUND ART

In general, petroleum products largely change viscosities depending on temperatures, or they have temperature dependency in viscosity. In lubricating oils, for example, used in automobiles, temperature dependency in viscosity is preferably small. To lubricating oils are thus added a certain polymer soluble in a lubricant base oil as a viscosity modifier in order to reduce the temperature dependency in viscosity. Ethylene/α-olefin copolymers have recently been widely used as the viscosity modifier, and variously modified to improve a property balance of the lubricating oil (see, Patent Document 1).

Viscosity modifiers as described above are generally used for keeping an appropriate viscosity at high temperatures. Recently, with advancement in fuel efficiency as part of an effort to reduce environmental burdens, there has been a need for a viscosity-improving polymer capable of suppressing a viscosity increase particularly at lower temperature, or having excellent low-temperature characteristics. The polymers described in Patent Document 1 are effectively used, because keeping a polymer concentration as low as possible in general applications of lubricating oil is effective for achieving excellent low-temperature characteristics and advantageous in terms of economical efficiency.

However, in an application of lubricating oil for power transmission system, which is the field of the present invention, the lubricating oil is required to have more advanced low-temperature characteristics and shear stability, and to have quality based on the consideration for a balance of both performances. In this regard, the present inventors have studied and found that the viscosity modifiers described in Patent Document 1 still have a room for improvement.

In such a situation, as the result of extensive investigation, the present inventors have found that by using an ethylene/α-olefin copolymer having an ethylene content, a molecular weight, a molecular weight distribution, and a melting point each in specific ranges as a viscosity modifier of a lubricating oil for power transmission system, the problem described above is solved, and accomplished the present invention.

Patent Document 1: WO 00/34420 Pamphlet

DISCLOSURE OF THE INVENTION

Problem to be Solved by the Invention

An object of the present invention is to provide a viscosity modifier that produces a lubricating oil composition for power transmission system excellent in shear stability and to provide the lubricating oil composition for power transmission system excellent in shear stability.

Means for Solving Problem (1) The viscosity modifier of a lubricating oil for power transmission system of the present invention comprises an ethylene/α-olefin copolymer (B) having the following characteristics (B1) to (B4):

(B1) an ethylene content within the range of 70 to 85% by mol;

(B2) an intrinsic viscosity [η] within the range of 0.2 to 1.0 dl/g;

(B3) Mw/Mn of 2.4 or lower; and (B4) a melting point, as measured by DSC, of 60° C. or lower, or no melting point observed.

The present invention also provides the following lubricating oil compositions for power transmission system to solve the problem:

(2) The lubricating oil composition for power transmission system, comprising a mineral oil type lubricant base oil (A) having the following characteristics (A0-1) to (A0-3) and an ethylene/α-olefin copolymer (B) having the following characteristics (B1) to (B4), in which a content of the ethylene/x-olefin copolymer (B) is 0.1 to 10% by weight (in which, a weight of the lubricating oil composition is 100% by weight);

(A0-1) a kinematic viscosity within the range of 2 to 10 $mm^2/s$ at 100° C., (A0-2) a viscosity index of 90 or higher, (A0-3) a pour point of −20° C. or lower, (B1) an ethylene content within the range of 70 to 85% by mol, (B2) an intrinsic viscosity [α] within the range of 0.2 to 1.0 dl/g, (B3) Mw/Mn of 2.4 or lower, and (B4) a melting point, as measured by DSC, of 60° C. or lower, or no melting point observed.

(3) The lubricating oil composition for power transmission system according to (2), in which the mineral oil type lubricant base oil (A) comprises 20 to 60% by weight of a mineral oil (AI) having the following characteristics (AI-1) to (AI-3) and 40 to 80% by weight of mineral oil (AII) having the following characteristics (AII-1) to (AII-3) (in which the total of (AI) and (AII) is 100% by weight);

(AI-1) a kinematic viscosity within the range of 2 to 10 $mm^2/s$ at 100° C., (AI-2) a viscosity index of 110 or higher, (AI-3) a pour point of −10° C. or lower, (AII-1) a kinematic viscosity within the range of 2 to 10 $mm^2/s$ at 100° C., (AII-2) a viscosity index of 70 or higher, (AII-3) a pour point of −35° C. or lower.

(4) The lubricating oil composition for power transmission system according to (2) or (3), in which the mineral oil type lubricant base oil (A) has a Cp of less than 70% in accordance with ASTM D3238.

(5) A lubricating oil composition for power transmission system comprising a mineral oil type lubricant base oil (A), the following ethylene/α-olefin copolymer (B), and a polymethacrylate viscosity modifier, in which a content of the ethylene/α-olefin copolymer (B) is 0.1 to 10% by weight and a content of the polymethacrylate viscosity modifier is 3 to 20% by weight (in which, a weight of the lubricating oil composition is 100% by weight);

(B1) an ethylene content within the range of 70 to 85% by mol, (B2) an intrinsic viscosity [η] within the range of 0.2 to 1.0 dl/g, (B3) Mw/Mn of 2, 4 or lower, and (B4) a melting point, as measured by DSC, of 60° C. or lower, or no melting point observed.

(6) The lubricating oil composition for power transmission system according to (5), in which the mineral oil type lubricant base oil (A) satisfies the following characteristics;

(A0-1) a kinematic viscosity within the range of 2 to 10 $mm^2/s$ at 100° C., (A0-2) a viscosity index of 90 or higher, (A0-3) a pour point of −20° C. or lower.

Effects of the Invention

The viscosity modifier of lubricating oil for power transmission system of the present invention can produce a lubricating oil composition for power transmission system excellent in shear stability. The viscosity modifier is also excellent in economical efficiency, because it exhibits the effect even when an amount of the added ethylene/α-olefin copolymer is small.

Further, the viscosity modifier of lubricating oil for power transmission system of the present invention is particularly suitable for preparation of a lubricating oil composition for power transmission system excellent in low-temperature viscosity characteristics and shear stability.

The lubricating oil composition for power transmission system of the present invention is excellent in low-temperature viscosity characteristics and shear stability, and also excellent in economical efficiency as it exhibits the effect even when an amount of the added ethylene/α-olefin copolymer is small. The lubricating oil composition is thus suitable for automotive/industrial transmission oils, power steering oils, hydraulic oils, and the like, in particular, lubricating oils for power transmission systems such as transmission oils and hydraulic oils.

BEST MODE FOR CARRYING OUT THE INVENTION

The lubricating oil composition for power transmission system according to the present invention comprises the ethylene/α-olefin copolymer (B) and the mineral oil type lubricant base oil (A) described below.

[Ethylene/α-Olefin Copolymer (B)]

The ethylene/α-olefin copolymer (B) used in the present invention is a polymer for modifying the viscosity of a lubricating oil.

Examples of an α-olefin constituting the ethylene/α-olefin copolymer (B) include α-olefins having 3 to 20 carbon atoms, more preferably 3 to 12 carbon atoms such as propylene, butene-1, pentene-1, hexene-1, heptene-1, octene-1, decene-1, undecene-1, dodecene-1, tridecene-1, tetradecene-1, pentadecene-1, hexadecene-1, heptadecene-1, octadecene-1, nonadecene-1, and eicosene-1. The ethylene/α-olefin copolymer (B) may comprise one or more constituent units derived from those α-olefins. Among those α-olefins, in terms of providing preferable low-temperature viscosity characteristics, shear stability, and heat resistance to the lubricating oil composition, propylene is preferred.

The ethylene/α-olefin copolymer (B) used in the present invention has the following characteristics (B1) to (B4).

(B1) Ethylene Content:

In the ethylene/α-olefin copolymer (B) of the present invention, the ethylene unit content is within the range of 70 to 85% by mol, preferably within the range of 70 to 80% by mol, and more preferably within the range of 75 to 80% by mol.

The ethylene unit content of the ethylene/α-olefin copolymer (B) is measured by $^{13}C$-NMR according to the method described in "Handbook of Polymer Analysis (Kobunshi Bunseki Handbook)" (Asakura Publishing Co., Ltd., P. 163-170).

(B2) Intrinsic Viscosity [η](dl/g):

In the ethylene/α-olefin copolymer (B) of the present invention, the intrinsic viscosity [η] is within the range of 0.2 to 1.0 dl/g, preferably within the range of 0.4 to 0.8 dl/g, and more preferably within the range of 0.5 to 0.7 dl/g.

The intrinsic viscosity [η] is measured in decaline at 135° C.

The lubricating oil composition comprising the ethylene/α-olefin copolymer (B) having the intrinsic viscosity [η] within the range described above has well-balanced shear stability and low-temperature characteristics.

(B3) Molecular Weight Distribution:

In the ethylene/α-olefin copolymer (B) of the present invention, Mw/Mn (Mw: weight average molecular weight, Mn: number average molecular weight), which is an index of molecular weight distribution, is 2.4 or lower, and preferably within the range from 1 to 2.2.

The weight average molecular weight (Mw) and the number average molecular weight (Mn) are measured by GPC (gel permeation chromatography) at 140° C. in ortho-dichlorobenzene solvent.

A molecular weight distribution exceeding 2.4 may reduce shear stability of a lubricating oil viscosity.

(B4) Melting Point (Tm):

The ethylene/α-olefin copolymer (B) of the present invention is a copolymer having a melting point of 60° C. or lower measured by using a DSC or no melting point observed, and preferably a copolymer having a melting point of 50° C. or lower measured by DSC or no melting point observed.

A melting point of the ethylene/(x-olefin copolymer (B) is measured by using a differential scanning calorimeter (DSC) Specifically, the melting point is determined from an endothermic curve measured by heating about 5 mg of sample packed in an aluminium pan to 200° C., holding for five minutes at 200° C., cooling to −40° C. at a rate of 10° C./min, holding for five minutes at −40° C., and raising a temperature at a rate of 10° C./min.

For the ethylene/α-olefin copolymer (B), a sample oil prepared by using a mineral oil having a kinematic viscosity of 3.6 $mm^2/s$ at 100° C. as a base oil and adding 7.5 parts by weight of LZ-9632F (The Lubrizol Corporation) as an additive package and 0.3 parts by weight of Aclube 146 (Sanyo Chemical Industries, Ltd.) as a pour point depressant so that the kinematic viscosity at 100° C. is about 7 $mm^2/s$ preferably has a viscosity decrease of 20% or lower, and preferably from 5 to 10% measured by a ultrasonic shearing tester according to JASO (Society of Automotive Engineers of Japan, Inc.), in terms of shear stability in the lubricating oil composition.

The mineral oil having a kinematic viscosity of 3.6 $mm^2/S$ at 100° C. can be selected from the groups (I, II, III) described hereinbelow without limitation. A kinematic viscosity of 3.6 $mm^2/S$ includes kinematic viscosities becoming 3.6 $mm^2/s$ by rounding off them to one decimal place.

A method for measuring a viscosity decrease with an ultrasonic shearing tester according to JASO (Society of Automotive Engineers of Japan, Inc.) is as described in the Examples.

The ethylene/α-olefin copolymer (B) as described can be prepared by copolymerizing ethylene and an α-olefin in the presence of a catalyst comprising a transition metal compound such as vanadium, zirconium, and titanium, and an organoaluminum compound (organoaluminum oxy-compound) and/or an ionized ionic compound. Examples of the catalyst used for olefin copolymerization include a catalyst described in WO 00/34420 Pamphlet.

[Mineral Oil Type Lubricant Base Oil (A)]

The mineral oil type lubricant base oil (A) used in the present invention can be any lubricant base oil generally used without limitation.

A mineral oil used as a lubricant base oil is generally subjected to purification steps such as dewaxing, and graded according to purification methods. The grade is defined by the API (American Petroleum Institute) classification. Table 1 shows characteristics of lubricant base oils of respective groups.

TABLE 1

| Group | Type | Viscosity index *1 | Saturated hydrocarbon content *2 (vol %) | Sulfur content *3 (% by weight) |
|---|---|---|---|---|
| (I)*4 | Mineral oil | 80-120 | <90 | >0.03 |
| (II) | Mineral oil | 80-120 | ≧90 | ≦0.03 |
| (III) | Mineral oil | ≧120 | ≧90 | ≦0.03 |
| (iv) | Poly-α-olefin | | | |
| (v) | Lubricant base oils other than those listed above | | | |

*1: measured in accordance with ASTM D445 (JIS K2283)

*2: measured in accordance with ASTM D3238

*3: measured in accordance with ASTM D4294 (JIS K2541)

*4: mineral oils in which a saturated hydrocarbon content is less than 90 (vol %) and a sulfur content is less than 0.03% by weight, or a saturated hydrocarbon content is 90 (vol %) or higher and a sulfur content is more than 0.03% by weight are also included in group (I).

The poly-α-olefin in Table 1 is a hydrocarbon polymer obtained by polymerization of at least an α-olefin having 10 or more carbon atoms as a raw material monomer. Examples of the poly-α-olefin include a polydecene obtained by polymerization of decene-1.

Examples of the mineral oil type lubricant base oil include those having a kinematic viscosity within the range of 2 to 10 $mm^2/s$ at 100° C.

The mineral oil type lubricant base oil of the present invention preferably has the following characteristics (A0-1) to (A0-3) in terms of low-temperature characteristics.

(A0-1) a kinematic viscosity within the range of 2 to 10 $mm^2/s$ at 100° C., (A0-2) a viscosity index of 90 or higher, (A0-3) a pour point of −20° C. or lower.

The characteristics are measured as below.

Kinematic viscosity at 100° C.: measured by a method described in ASTM D445 (JIS K2283).

Viscosity index: measured by a method described in ASTM D2270 (JIS K2283).

Pour point: measured by a method described in ASTM D97 (JIS K2269).

More specifically, the mineral oil type lubricant base oil (A) preferably has the following characteristics.

(A0-1) The kinematic viscosity at 100° C. is 2 to 10 $mm^2/s$, and preferably 3 to 8 $mm^2/s$. When the kinematic viscosity is within the range, the resultant lubricating oil composition for power transmission system has well-balanced lubricating oil characteristics such as oil film strength and low-temperature characteristics.

(A0-2) The viscosity index is 90 or higher, and preferably 100 or higher. The upper limit of the viscosity index is not specifically limited, but generally used are those having the viscosity index of 160 or lower, and particularly 130 or lower. When the viscosity index is 90 or higher, the mineral oil type lubricant base oil is particularly useful as a base oil of the lubricating oil for power transmission system.

(A0-3) The pour point is −20° C. or lower, and preferably −25° C. or lower. The lower limit of the pour point is not specifically limited, but generally used are those having the pour point of −45° C. or higher, and particularly −40° C. or higher. By using those satisfying the ranges as the mineral oil type lubricant base oil (A), the lubricating oil composition comprising the ethylene/α-olefin copolymer can have good fluidity under low temperature conditions.

The mineral oil type lubricant base oil used in the present invention preferably satisfies the characteristics (A0-1) to (A0-3). As the mineral oil type lubricant base oil, those comprising a mineral oil (AI) having the following characteristics (AI-1) to (AI-3) and a mineral oil (AII) having the following characteristics (AII-1) to (AII-3) can be used.

(AI-1) The kinematic viscosity at 100° C. is 2 to 10 $mm^2/s$, preferably 3 to 8 $mm^2/s$, and more preferably 3.8 to 8 $mm^2/s$.

(AI-2) The viscosity index is 110 or higher, preferably 115 or higher, and more preferably 120 or higher. In this case, the upper limit of the viscosity index is not specifically limited, but generally used are those having a viscosity index of 160 or lower.

(AI-3) The pour point is −10° C. or lower. The lower limit of the pour point is not specifically limited, but generally used are those having the pour point of −30° C. or higher, and particularly of −20° C. or higher.

The mineral oil (AI) having the kinematic viscosity within the range at 100° C. can keep an appropriate lubrication at high temperature. The mineral oil (AI) having the viscosity index within the range has a lower temperature dependency in viscosity and thus prevents viscosity increase to provide good fluidity at low temperature.

(AII-1) The kinematic viscosity at 100° C. is 2 to 10 $mm^2/s$, preferably 3 to 8 $mm^2/s$.

(AII-2) The viscosity index is 70 or higher, preferably from 70 to 110.

(AII-3) The pour point is −35° C. or lower, and preferably −40° C. The lower limit of the pour point is not specifically limited, but generally used are those having the pour point of −55° C. or higher.

The mineral oil (AII) having a kinematic viscosity within the range at 100° C. can keep an appropriate lubrication at high temperature. The mineral oil (AII) having a pour point within the range can have a good fluidity at low temperature due to its low pour point.

The mineral oil type lubricant base oil (A) used in the present invention preferably comprises the mineral oil (AI) having the characteristics (AI-1) to (AI-3) in a percentage of 20 to 60% by weight, preferably 30 to 50% by weight, and the mineral oil (AII) having the characteristics of (AII-1) to (AII-3) in a percentage of 40 to 80% by weight, preferably 50 to 70% by weight (in which, the total of (AI) and (AII) is 100% by weight). The mineral oil type lubricant base oil (A) of the present invention comprising 20 to 60% by weight of the mineral oil (AI) and 40 to 80% by weight of the mineral oil (AII) provides the lubricating oil composition having a lower pour point. Particularly when a pour point depressant described below is added to the lubricating oil composition, a pour point-lowering effect is large. A lubricating oil composition having a pour point of, for example, −37.5° C. or lower, preferably −40° C. or lower can be obtained.

The mineral oil type lubricant base oil (A) of the present invention preferably has a Cp value, which is prescribed in ASTM D3238, of lower than 70%, and more preferably 69% or lower. The lower limit of the Cp value is not specifically limited, but generally used are those having Cp values of 60% or higher.

In the present invention, the mineral oil type lubricant base oil (A) having a Cp value of less than 70% can provide a lubricating oil composition having preferable properties for power transmission oil. The mineral oil type lubricant base oil (A) having a Cp value of less than 70% can also provide a lubricating oil composition having a lower pour point. In this lubricating oil composition, the pour point depressant described below, if used, exhibits a particularly large pour point-lowering effect. For example, a lubricating oil composition having a pour point of −37.5° C. or lower, and preferably −40° C. or lower can be obtained.

For the mineral oil (AI), any mineral oil having the characteristics (AI-1) to (AI-3) can be used without specific limitation. Examples of the mineral oil include mineral oils having high viscosity index classified in groups (II) or (III) of API grade classification and purified by hydrogenolysis etc.

For the mineral oil (AII), any mineral oil having the characteristics (AII-1) to (AII-3) can be used without specific limitation. Examples of the mineral oil include mineral oils having low pour points prepared by highly dewaxing such as a catalytic dewaxing method.

In the present invention, the mineral oil type lubricant base oil (A) refers to a lubricant base oil consisting of a mineral oil. That is, the lubricant base oil contains no oils other than the mineral oil.

The lubricating oil composition for power transmission system of the present invention may contain lubricant base oil other than the mineral oil type lubricant base oil (A). The other lubricant base oil may be generally contained in an amount of 10 parts by weight or lower relative to 100 parts by weight of the mineral oil type lubricant base oil (A). An embodiment of the lubricating oil composition containing no lubricant base oils other than the mineral oil type lubricant base oil (A) is preferred one.

Also in the case of the mineral oil type lubricant base oil (A) satisfying the characteristics (A0-1) to (A0-3), the lubricating oil composition for power transmission system of the present invention may contain lubricant base oil other than the mineral oil type lubricant base oil (A), generally in an amount 10 parts by weight or lower relative to 100 parts by weight. In this case, an embodiment of the lubricating oil composition containing no lubricant base oils other than the mineral oil type lubricant base oil (A) is preferred one.

In the case of the mineral oil type lubricant base oil (A) satisfying the characteristics (A0-1) to (A0-3) and containing the mineral oil (AI) and the mineral oil (AII), the mineral oil type lubricant base oil (A) may contain other mineral oil not corresponding to the mineral oil (AI) or the mineral oil (AII) as long as the mineral oil type lubricant base oil (A) satisfies all of (A0-1) to (A0-3). Specifically, the mineral oil not corresponding to the mineral oil (AI) or the mineral oil (AII) may be contained in the mineral oil type lubricant base oil (A) in an amount of 10 parts by weight or lower relative to the total 100 parts by weight of the mineral oil type lubricant base oil (A). The lubricating oil composition for power transmission system of the present invention may further contain lubricant base oil other than the mineral oil type lubricant base oil (A) in an amount of 10 parts by weight or lower relative to 100 parts by weight of the mineral oil type lubricant base oil (A). An embodiment of the lubricant base oil consisting of a mineral oil corresponding to (A1) and a mineral oil corresponding to (A2) is preferred one.

[Lubricating Oil Composition]

The lubricating oil composition for power transmission system according to the present invention comprises the mineral oil type lubricant base oil (A) and the ethylene/α-olefin copolymer (B), in which the percentage of the ethylene/α-olefin copolymer (B) is 0.1 to 10% by weight, preferably 0.3 to 5% by weight, and more preferably 0.5 to 3% by weight of the total composition.

The lubricating oil composition for the power transmission system according to the present invention can comprise other additives such as other viscosity modifiers, pour point depressants, detergent dispersants, extreme-pressure agents, friction modifiers, oily agent, antioxidants, antifoaming agents, rust-proofing agents, and corrosion inhibitors according to need, in an amount of 30% by weight or lower, and preferably 0.1 to 30% by weight of the total of the composition.

The lubricating oil composition for the power transmission system as described has excellent shear stability and well-balanced pour point and viscosity index, and exhibits particularly good low-temperature viscosity characteristics. In the case of the mineral oil type lubricant base oil satisfying the characteristics (A0-1) to (A0-3), particularly in the case of the mineral oil type lubricant base oil (A) satisfying the characteristics (A0-1) to (A0-3) and containing the mineral oil (AI) and the mineral oil (AII), the lubricating oil composition for the power transmission system has well-balanced pour point and viscosity index, and can exhibit good low-temperature viscosity characteristics that cannot be achieved by the use of individual mineral oils.

Additives used together according to need will be described below.

(Other Viscosity Modifier)

Preferred other viscosity modifier that can be used according to need is a polymethacrylate viscosity modifier that is a polymer or copolymer of alkyl methacrylate. The content thereof is 1 to 20% by weight, and preferably 3 to 20% by weight of the total composition. In some cases, the viscosity modifier contains a solvent in addition to the polymer or copolymer. The content 1 to 20% by weight refers to an amount including such a solvent.

The polymethacrylate viscosity modifier used in the lubricating oil for power transmission system preferably has a low molecular weight, because it is required particularly to have high shear stability. Examples of a commercial product name include Aclube 806T and Aclube 728 manufactured by Sanyo Chemical Industries, Ltd., and VISCOPLEX 0-111 and VISCOPLEX 0-113 manufactured by ROHMAX. As the other viscosity modifier, commercially available viscosity modifiers can be used.

When one containing a polymer or copolymer of alkyl methacrylate is used as the other viscosity modifier, the resultant lubricating oil composition has good low-temperature viscosity characteristics, and thus the below-described pour point depressant may not be used. When one containing a polymer or copolymer of alkyl methacrylate is used as the other viscosity modifier, and the below-described pour point depressant is used, the resultant lubricating oil composition has good low-temperature viscosity characteristics even if the total amount of the added ethylene/α-olefin copolymer (B) and the added viscosity modifier is small. When one containing a polymer or copolymer of alkyl methacrylate is used as the other viscosity modifier, it is preferably used together with the mineral oil type lubricant base oil (A), more preferably the mineral oil type lubricant base oil (A) satisfying the characteristics (A0-1) to (A0-3), and particularly preferably the mineral oil type lubricant base oil (A) containing the mineral oils (AI) and (AII) in the amount ratio described above.

(Pour Point Depressant)

Examples of the pour point depressant include polymers or copolymers of alkyl methacrylate, polymers or copolymers of alkyl acrylate, polymers or copolymers of alkyl fumarate, polymers or copolymers of alkyl maleate, and alkyl aromatic compounds. Among them, a polymethacrylate pour point depressant that is a pour point depressant comprising polymers or copolymers of alkyl methacrylate is particularly preferred. A carbon number of an alkyl group of the alkyl methacrylate is preferably 12 to 20. A content thereof is 0.05 to 2% by weight of the total composition. These are commercially available pour point depressants. Examples of a commercially available product name include Aclube 146 and Aclube 136 manufactured by Sanyo Chemical Industries, Ltd., and Lubran 141 and Lubran 171 manufactured by TOHO Chemical Industry Co., Ltd.

In some cases, the pour point depressant contains a solvent in addition to the polymer or copolymer. The content 0.05 to 2% by weight refers to an amount including such a solvent.

The lubricating oil composition containing the pour point depressant in the amount described as above exhibits good low-temperature fluidity under the condition of −40° C., and thus is useful as the lubricating oil composition for power transmission system, and particularly as a lubricating oil composition for transmission.

(Detergent Dispersant)

Examples of the detergent dispersant include sulfonate dispersants such as calcium sulfonate and magnesium sulfonate; phenates; salicylates; succinimides; and benzylamines.

(Extreme-Pressure Agent)

Examples of the extreme-pressure agent include sulfurized oil and fat, sulfurized olefins, sulfides, phosphate, phosphite, phosphate amine salts, and phosphite amine salts.

(Friction Modifier)

Examples of the friction modifier include organomolybdenum compounds such as molybdenum dithiophosphate and molybdenum dithiocarbamate, which are typical organometal friction modifiers.

Examples of the oily agent include fatty acids having alkyl groups of 8 to 22 carbon atoms, fatty acid esters, and higher alcohols.

(Antioxidant)

Specific examples of the antioxidant include phenolic antioxidants such as 2,6-di-t-butyl-4-methylphenol; and amine-based antioxidants such as dioctyldiphenylamine.

(Antifoaming Agent)

Examples of the antifoaming agent include silicon-based antifoaming agents such as dimethylsiloxane and silica gel dispersion; and alcohol- and ester-based antifoaming agents.

Examples of the rust-proofing agent include carboxylic acids, carboxylates, esters, and phosphoric acid.

(Corrosion Inhibitor)

Examples of the corrosion inhibitor include benzotriazole-based, thiadiazole-based, imidazole-based compounds.

A total amount of the mineral oil type lubricant base oil (A), or of the mineral oil type lubricant base oil (A) and lubricant base oil other than (A) optionally added is generally a remaining amount after subtracting the ethylene/α-olefin copolymer (B) and the additives (which includes (C) a polymethacrylate viscosity modifier used according to need and (D) a pour point depressant used according to need) from 100% by weight of total composition.

A pour point of the lubricating oil composition for power transmission system of the present invention is preferably −37.5° C. or lower, and more preferably −40° C. or lower.

The lubricating oil composition for power transmission system of the present invention is particularly excellent in shear stability and low-temperature viscosity characteristics, and thus effective for applications as a lubricating oil for power transmission system such as a transmission oil and a hydraulic fluid. Examples of the lubricating oil for power transmission system include transmission oils for automobiles and industrial machines, power steering oils, hydraulic working oils. The lubricating oil composition of the present invention is particularly suitable for power transmission systems such as transmission oils and hydraulic oils.

EXAMPLES

The present invention will be described below in detail with reference to Examples, but is not be limited to Examples.

In Examples, properties were measured as described below.

<Ethylene Content>

An ethylene content was measured in a mixed solvent of orthodichlorobenzene and benzene-d6 (orthodichlorbenzene/benzene-d6=3/1 to 4/1 (volume ratio)) under the conditions of 120° C., a pulse width of 450 pulses, and a pulse repetition interval of 5.5 seconds by a JEOL LA500-model nuclear magnetic resonance spectrometer.

<Intrinsic Viscosity [η]>

An intrinsic viscosity was measured at 135° C. in decaline.

<Mw/Mn>

Mw/Mn was measured at 140° C. in orthodichlorobenzene solvent by GPC (gel permeation chromatograph).

<Kinematic viscosity (KV) at 100° C.>

A kinematic viscosity (KV) was measured in accordance with ASTM D445. In Examples, when a sample oil was formulated for a manual transmission oil, it was adjusted so that KV was 15 $mm^2/s$, and when for an automatic transmission oil, KV was 7 $mm^2/s$.

<Low-Temperature Viscosity at −40° C.>

A low-temperature viscosity was measured by a BF (Brookfield) viscometer in accordance with ASTM D341.

<Shear Stability (Viscosity Reduction Rate %)>

In Examples, when a sample oil was for a manual transmission oil, it was measured for a reduction rate of kinematic viscosity at 100° C. after a 20 hours shearing test by using a KRL shearing test machine in accordance with CEC-L-45 (CEC: an organization for the management of test procedures for the performance testing of automotive fuels & lubricants in Europe).

When a sample oil was for an automatic transmission oil, it was irradiated by a ultrasonic wave for 60 minutes at such output voltage as decreasing a kinematic viscosity at 100° C. of ASTM standard oil A by 30% by irradiating for 10 minutes, and then measured for a reduction rate of kinematic viscosity at 100° C., using a SONIC shearing test machine in accordance with JASO-M347-95 (JASO: Society of Automotive Engineers of Japan, Inc., Standardization Board).

A shear stability is a scale of kinematic viscosity loss due to cleavage of molecular chain by shearing of a copolymer component in a lubricating oil at a metal sliding part.

Polymerization Example 1

In a 2 L continuous polymerization reactor equipped with an agitation blade, the inner space of which was fully substituted with nitrogen, 1 L of dehydrated pure hexane was charged, and continuously fed a hexane solution of ethylaluminium sesquichloride ($Al(C_2H_5)_{1.5}.Cl_{1.5}$) prepared to 8.0 mmol/l at an amount of 500 ml/h for 1 hour, and then continuously fed a hexane solution of $VO(OC_2H_5)Cl_2$ prepared to 0.8 mmol/l as a catalyst at an amount of 500 ml/h and hexane at an amount of 500 ml/h.

At the same time, a polymerization mixture was continuously taken off from the top of the polymerization reactor so that a polymerization mixture in the polymerization reactor was constantly kept to 1 L. Then, using a bubbling tube, ethylene, propylene, and hydrogen were fed at amounts of 230 L/h, 70 L/h, and 9.8 L/h, respectively. Copolymerization was conducted at 35° C. by circulating a refrigerant in a jacket equipped externally to the polymerization reactor.

The reaction conducted under the above conditions gave a polymerization mixture containing an ethylene/propylene copolymer. The resultant polymerization mixture was deashed with hydrochloric acid, charged in a large amount of methanol to precipitate the ethylene/propylene copolymer, and then dried under reduced pressure at 130° C. for 24 hours. Properties of the resultant polymer are shown in Table 2.

Polymerization Example 2

Copolymerization was similarly conducted as in Polymerization Example 1, except that an amount of fed hydrogen was 9.1 L/h. Properties of the resultant polymer are shown in Table 2.

Polymerization Example 3

Copolymerization was similarly conducted as in Polymerization Example 1, except that an amount of fed hydrogen was 8.0 L/h. Properties of the resultant polymer are shown in Table 2.

Polymerization Example 4

Copolymerization was similarly conducted as in Polymerization Example 1, except that an amount of fed hydrogen was 7.1 L/h. Properties of the resultant polymer are shown in Table 2.

Polymerization Example 5

Copolymerization was similarly conducted as in Polymerization Example 1, except that an amount of fed hydrogen was 4.5 L/h. Properties of the resultant polymer are shown in Table 2.

Polymerization Example 6

In a 2 L continuous polymerization reactor equipped with an agitation blade, the inner space of which was fully substituted with nitrogen, 1 L of dehydrated pure hexane was charged, and continuously fed a hexane solution of ethylaluminium sesquichloride ($Al(C_2H_5)_{1.5}.Cl_{1.5}$) prepared to 8.0 mmol/l at an amount of 500 ml/h for 1 hour, and then continuously fed a hexane solution of $VO(OC_2H_5)Cl_2$ prepared to 0.8 mmol/l as a catalyst at an amount of 500 ml/h and hexane at an amount of 500 ml/h.

At the same time, a polymerization mixture was continuously taken off from the top of the polymerization reactor so that a polymerization mixture in the polymerization reactor was constantly kept to 1 L. Then, using a bubbling tube, ethylene, propylene, and hydrogen were fed at amounts of 180 L/h, 120 L/h, and 7.2 L/h, respectively. Copolymerization was conducted at 15° C. by circulating a refrigerant in a jacket equipped externally to the polymerization reactor.

The reaction conducted under the above conditions gave a polymerization mixture containing an ethylene/propylene copolymer. The resultant polymerization mixture was deashed with hydrochloric acid, charged in a large amount of methanol to precipitate the ethylene/propylene copolymer, and then dried under reduced pressure at 130° C. for 24 hours. Properties of the resultant polymer are shown in Table 2.

Polymerization Example 7

In a 2 L continuous polymerization reactor equipped with an agitation blade, the inner space of which was fully substituted with nitrogen, 1 L of dehydrated pure hexane was charged, and continuously fed a hexane solution of ethylaluminium sesquichloride ($Al(C_2H_5)_{1.5}.Cl_{1.5}$) prepared to 8.0 mmol/l at an amount of 500 ml/h for 1 hour, and then continuously fed a hexane solution of $VO(OC_2H_5)Cl_2$ prepared to 0.8 mmol/l as a catalyst at an amount of 500 ml/h and hexane at an amount of 500 ml/h.

At the same time, a polymerization mixture was continuously taken off from the top of the polymerization reactor so that a polymerization mixture in the polymerization reactor was constantly kept to 1 L. Then, using a bubbling tube, ethylene, propylene, and hydrogen were fed at amounts of 250 L/h, 60 L/h, and 7.0 L/h, respectively. Copolymerization was conducted at 50° C. by circulating a refrigerant in a jacket equipped externally to the polymerization reactor.

The reaction conducted under the above conditions gave a polymerization mixture containing an ethylene/propylene copolymer. The resultant polymerization mixture was deashed with hydrochloric acid, charged in a large amount of methanol to precipitate the ethylene/propylene copolymer, and then dried under reduced pressure at 130° C. for 24 hours. Properties of the resultant polymer are shown in Table 2.

TABLE 2

| Polymer property | Polymerization Example 1 | Polymerization Example 2 | Polymerization Example 3 | Polymerization Example 4 | Polymerization Example 5 | Polymerization Example 6 | Polymerization Example 7 |
|---|---|---|---|---|---|---|---|
| Ethylene content (% by mol) | 78.1 | 78.3 | 78.0 | 78.3 | 78.1 | 60.0 | 86.5 |
| Propylene content (% by mol) | 21.9 | 21.7 | 22.0 | 21.7 | 21.9 | 40.0 | 13.5 |
| [η] (dl/g) | 0.15 | 0.33 | 0.55 | 0.75 | 1.33 | 0.74 | 0.75 |
| Mw/Mn | 1.9 | 2.1 | 2.0 | 2.0 | 1.9 | 2.1 | 2.0 |
| Melting point (° C.) | 42.9 | 44.5 | 45.0 | 46.4 | 46.8 | −40.4 | 50.7 |

Example 1

A lubricating oil comprising: as a lubricant base oil (A) (base oil), 82.19% by weight of oil mixture (kinematic viscosity at 100° C.: 5.503 $mm^2/S$) prepared by mixing a mineral oil VHVI-6 (SK Corporation) classified into Group (III) having a kinematic viscosity of 6.501 $mm^2/s$ at 100° C., a viscosity index of 131, and a pour point of −15° C. and a highly dewaxed mineral oil having a low pour point (Exxon-Mobil Corporation, LP-40) having a viscosity of 4.863 $mm^2/s$ at 100° C., a viscosity index of 86, and a pour point of −45° C. at a ratio of 40% by weight of VHVI-6 to 60% by weight of LP-40; as a viscosity modifier, 7.51% by weight of ethylene/propylene copolymer (B) obtained in Polymerization Example 2; as a pour point depressant (C), 0.3% by weight of Aclube 146 (Sanyo Chemical Industries, Ltd.); and 10.0% by weight of extreme-pressure agent Anglamol 98A (The Lubrizol Corporation) was prepared. Properties of the lubricating oil were evaluated. The results are listed in Table 3.

Example 2

A lubricating oil was similarly prepared and evaluated as in Example 1, except that the lubricating oil comprised 86.46% by weight of the oil mixture used in Example 1 as a lubricant base oil (A) and 3.24% by weight of ethylene/propylene copolymer (B) obtained in Polymerization Example 3 as a viscosity modifier. The results are listed in Table 3.

Example 3

A lubricating oil was similarly prepared and evaluated as in Example 1, except that the lubricating oil comprised 87.19% by weight of the oil mixture used in Example 1 as a lubricant base oil (A) and 2.51% by weight of ethylene/propylene copolymer (B) obtained in Polymerization Example 4 as a viscosity modifier. The results are listed in Table 3.

Example 4

A lubricating oil comprising: as a lubricant base oil (A), 86.10% by weight of oil mixture (kinematic viscosity at 100° C.: 4.917 $mm^2/s$) prepared by mixing a NEXBASE-3050 (Fortum) classified into Group (III) having a kinematic viscosity of 4.998 $mm^2/s$ at 100° C., a viscosity index of 133, and a pour point of −15° C. and a highly dewaxed mineral oil having a low pour point (Exxon-Mobil Corporation, LP-40) having a viscosity of 4.863 $mm^2/s$ at 100° C. at a ratio of 40% by weight of NEXBASE-3050 to 60% by weight of LP-40; as a viscosity modifier, 3.60% by weight of ethylene/propylene copolymer (B) obtained in Polymerization Example 3; as a pour point depressant (C), 0.3% by weight of Aclube 146 (Sanyo Chemical Industries, Ltd.); and as an extreme-pressure agent, 10.0% by weight of Anglamol 98A (The Lubrizol Corporation) was prepared. Properties of the lubricating oil were similarly evaluated as in Example 1. The results are listed in Table 3.

Example 5

A lubricating oil was similarly prepared and evaluated as in Example 4, except that the lubricating oil comprised 86.88% by weight of the oil mixture used in Example 4 as a lubricant base oil (A) and 2.82% by weight of ethylene/propylene copolymer (B) obtained in Polymerization Example 4 as a viscosity modifier. The results are listed in Table 3.

Example 6

A lubricating oil was similarly prepared and evaluated as in Example 4, except that the lubricating oil comprised 76.73% by weight of the oil mixture used in Example 4 as a lubricant base oil (A), 1.27% by weight of ethylene/propylene copolymer (B) obtained in Polymerization Example 4 and 12.0% by weight of polymethacrylate viscosity modifier Aclube 806T (Sanyo Chemical Industries, Ltd.) as viscosity modifiers, and a pour point depressant (C) was not used. The results are listed in Table 3.

TABLE 3

| | Example 1 | Example 2 | Example 3 | Example 4 | Example 5 | Example 6 |
|---|---|---|---|---|---|---|
| | Polymer mixed | | | | | |
| | Polymerization Example 2 | Polymerization Example 3 | Polymerization Example 4 | Polymerization Example 3 | Polymerization Example 4 | Polymerization Example 4 |
| Composition and mixing ratio (% by weight) Within ( ):mixing ratio in (A) (% by weight) | | | | | | |
| Lubricant base oil (A) | 82.19 | 86.46 | 87.19 | 86.10 | 86.88 | 76.73 |
| (a) Mineral oil having a high viscosity index (VHVI-6 | (40) | (40) | (40) | | | |
| (b) Mineral oil having a high viscosity index (NEXBASE-3050) | | | | (40) | (40) | (40) |
| (c) Mineral oil having a low pour point (LP-40) | (60) | (60) | (60) | (60) | (60) | (60) |
| Ethylene/propylene copolymer (B) | 7.51 | 3.24 | 2.51 | 3.60 | 2.82 | 1.27 |
| Polymethacrylate viscosity modifier Aclube 806T | | | | | | 12.00 |
| Pour point depressant (C) Aclube 146 | 0.30 | 0.30 | 0.30 | 0.30 | 0.30 | |
| Extreme-pressure agent Anglamol 98A | 10.00 | 10.00 | 10.00 | 10.00 | 10.00 | 10.00 |

TABLE 3-continued

| | Example 1 | Example 2 | Example 3 | Example 4 | Example 5 | Example 6 |
|---|---|---|---|---|---|---|
| | Polymer mixed | | | | | |
| | Polymerization Example 2 | Polymerization Example 3 | Polymerization Example 4 | Polymerization Example 3 | Polymerization Example 4 | Polymerization Example 4 |
| Property of ethylene/propylene copolymer (B) | | | | | | |
| Ethylene content (mol %) | 78.3 | 78.0 | 78.3 | 78.0 | 78.3 | 78.3 |
| [η] (dl/g) | 0.33 | 0.55 | 0.75 | 0.55 | 0.75 | 0.75 |
| Property of lubricant base oil (A) | | | | | | |
| Kinematic viscosity (100° C.) ($mm^2/s$) | 5.488 | 5.488 | 5.488 | 4.900 | 4.900 | 4.900 |
| Viscosity index | 110 | 110 | 110 | 104 | 104 | 104 |
| Pour point (° C.) | −30.0 | −30.0 | −30.0 | −30.0 | −30.0 | −30.0 |
| Cp (% by weight) | 67.3 | 67.3 | 67.3 | 68.5 | 68.5 | 68.5 |
| Performance of oil composition | | | | | | |
| Kinematic viscosity (100° C.) ($mm^2/s$) | 15.01 | 15.06 | 14.97 | 15.04 | 15.00 | 14.85 |
| Brookfield low-temperature viscosity (−40° C.) (mpa · s) | 76800 | 57800 | 55700 | 54600 | 54100 | 45600 |
| Shear stability Viscosity reduction rate (%) at KRL test | 17.4 | 26.7 | 32.2 | 27.1 | 34.0 | 27.3 |

Example 7

A lubricating oil comprising: as a lubricant base oil (A), 88.73% by weight of oil mixture (kinematic viscosity at 100° C.: 3.628 $mm^2/S$) prepared by mixing a mineral oil VHVI-6 (SK Corporation) classified into Group (III) having a kinematic viscosity of 6.501 $mm^2/s$ at 100° C. and a highly dewaxed mineral oil having a low pour point (Exxon-Mobil Corporation, LP-35) having a viscosity of 2.826 $mm^2/s$ at 100° C., a viscosity index of 79, and a pour point of −50° C. at a ratio of 30% by weight of VHVI-6 to 70% by weight of LP-35; as a viscosity modifier, 3.47% by weight of ethylene/propylene copolymer (B) obtained in Polymerization Example 2; as a pour point depressant (C), 0.3% by weight of Aclube 146 (Sanyo Chemical Industries, Ltd.); and 7.5% by weight of additive package for automatic transmission oil (The Lubrizol Corporation, LZ-9632F) was prepared. Properties of the lubricating oil were evaluated. The results are listed in Table 4.

Example 8

A lubricating oil was similarly prepared and evaluated as in Example 7, except that the lubricating oil comprised 90.50% by weight of the oil mixture used in Example 7 as a lubricant base oil (A) and 1.70% by weight of ethylene/propylene copolymer (B) obtained in Polymerization Example 3 as a viscosity modifier. The results are listed in Table 4.

Example 9

A lubricating oil was similarly prepared and evaluated as in Example 7, except that the lubricating oil comprised 90.90% by weight of the oil mixture used in Example 7 as a lubricant base oil (A) and 1.30% by weight of ethylene/propylene copolymer (B) obtained in Polymerization Example 4 as a viscosity modifier. The results are listed in Table 4.

Example 10

A lubricating oil comprising: as a lubricant base oil (A), 90.50% by weight of oil mixture (kinematic viscosity at 100° C.: 3.633 $mm^2/s$) prepared by mixing a mineral oil NEXBASE-3050 (Fortum) classified into Group (III) having a kinematic viscosity of 4.998 $mm^2/s$ at 100° C. and a highly dewaxed mineral oil having a low pour point (Exxon-Mobil Corporation, LP-35) having a viscosity of 2.826 $mm^2/s$ at 100° C. at a ratio of 43% by weight of NEXBASE-3050 to 57% by weight of LP-35; and as a viscosity modifier, 1.70% by weight of ethylene/propylene copolymer (B) obtained in Polymerization Example 3 was prepared. Properties of the lubricating oil were evaluated. The results are listed in Table 4.

Example 11

A lubricating oil was similarly prepared and evaluated as in Example 10, except that the lubricating oil comprised 90.9% by weight of the oil mixture used in Example 10 as a lubricant base oil (A) and 1.30% by weight of ethylene/propylene copolymer (B) obtained in Polymerization Example 4 as a viscosity modifier. The results are listed in Table 4.

Example 12

A lubricating oil was similarly prepared and evaluated as in Example 10, except that the lubricating oil comprised 86.32% by weight of the oil mixture used in Example 10 as a lubricant base oil (A), 0.58% by weight of ethylene/propylene copolymer (B) obtained in Polymerization Example 4 and 5.6% by weight of polymethacrylate viscosity modifier Aclube 806T (Sanyo Chemical Industries, Ltd.) as viscosity adjusting agents, and a pour point depressant (C) was not used. The results are listed in Table 4.

TABLE 4

| | Example 7 | Example 8 | Example 9 | Example 10 | Example 11 | Example 12 |
|---|---|---|---|---|---|---|
| | Polymer mixed | | | | | |
| | Polymerization Example 2 | Polymerization Example 3 | Polymerization Example 4 | Polymerization Example 3 | Polymerization Example 4 | Polymerization Example 4 |
| Composition and mixing ratio (% by weight) Within ( ):mixing ratio in (A) (% by weight) | | | | | | |
| Lubricant base oil (A) | 88.73 | 90.50 | 90.90 | 90.50 | 90.90 | 86.32 |
| (a) Mineral oil having a high viscosity index (VHVI-6) | (30) | (30) | (30) | | | |
| (b) Mineral oil having a high viscosity index (NEXBASE-3050) | | | | (43) | (43) | (43) |
| (c) Mineral oil having a low pour point (LP-35) | (70) | (70) | (70) | (57) | (57) | (57) |
| Ethylene/propylene copolymer (B) | 3.47 | 1.70 | 1.30 | 1.70 | 1.30 | 0.58 |
| Polymethacrylate viscosity modifier Aclube 806T | | | | | | 5.60 |
| Pour point depressant (C) Aclube 146 | 0.30 | 0.30 | 0.30 | 0.30 | 0.30 | |
| Additive package for automatic transmission oil (LZ-9632F) | 7.50 | 7.50 | 7.50 | 7.50 | 7.50 | 7.50 |
| Property of ethylene/propylene copolymer (B) | | | | | | |
| Ethylene content (mol %) | 78.3 | 78.0 | 78.3 | 78.0 | 78.3 | 78.3 |
| [η] (dl/g) | 0.33 | 0.55 | 0.75 | 0.55 | 0.75 | 0.75 |
| Property of lubricant base oil (A) | | | | | | |
| Kinematic viscosity (100° C.) ($mm^2/s$) | 3.647 | 3.647 | 3.647 | 3.630 | 3.630 | 3.630 |
| Viscosity index | 103 | 103 | 103 | 104 | 104 | 104 |
| Pour point (° C.) | −35.0 | −35.0 | −35.0 | −30.0 | −30.0 | −30.0 |
| Cp (% by weight) | 65.5 | 65.5 | 65.5 | 68.2 | 68.2 | 68.2 |
| Performance of oil composition | | | | | | |
| Kinematic viscosity (100° C.) ($mm^2/s$) | 7.233 | 7.187 | 7.313 | 7.123 | 7.297 | 7.168 |
| Brookfield low-temperature viscosity (−40° C.) (mpa · s) | 18700 | 12420 | 11800 | 12250 | 11900 | 10200 |
| Shear stability Viscosity reduction rate (%) at JASO-SONIC test | 2.0 | 4.5 | 8.3 | 4.9 | 8.5 | 8.5 |
| Pour point (° C.) | <−40 | <−40 | <−40 | <−40 | <−40 | <−40 |

Comparative Example 1

A lubricating oil was similarly prepared and evaluated as in Example 1, except that the lubricating oil comprised 79.30% by weight of the oil mixture used in Example 1 as a lubricant base oil (A) and 10.40% by weight of ethylene/propylene copolymer (B) obtained in Polymerization Example 1 as a viscosity modifier. The results are listed in Table 5.

Comparative Example 2

A lubricating oil was similarly prepared and evaluated as in Example 1, except that the lubricating oil comprised 87.87% by weight of the oil mixture used in Example 1 as a lubricant base oil (A) and 1.83% by weight of ethylene/propylene copolymer (B) obtained in Polymerization Example 5 as a viscosity modifier. The results are listed in Table 5.

Comparative Example 3

A lubricating oil was similarly prepared and evaluated as in Example 1, except that the lubricating oil comprised 87.03% by weight of the oil mixture used in Example 1 as a lubricant base oil (A) and 2.67% by weight of ethylene/propylene copolymer (B) obtained in Polymerization Example 6 as a viscosity modifier. The results are listed in Table 5.

Comparative Example 4

A lubricating oil was similarly prepared and evaluated as in Example 1, except that the lubricating oil comprised 86.72% by weight of the oil mixture used in Example 4 as a lubricant base oil (A) and 2.98% by weight of ethylene/propylene copolymer (B) obtained in Polymerization Example 6 as a viscosity modifier. The results are listed in Table 5.

Comparative Example 5

A lubricating oil was similarly prepared and evaluated as in Example 1, except that the lubricating oil comprised 87.24% by weight of the oil mixture used in Example 1 as a lubricant base oil (A) and 2.46% by weight of ethylene/propylene copolymer (B) obtained in Polymerization Example 7 as a viscosity modifier. The results are listed in Table 5.

Example 13

A lubricating oil was similarly prepared and evaluated as in Example 1, except that the lubricating oil comprised 87.18% by weight of mineral oil VHVI-6 (SK Corporation) having a kinematic viscosity of 6.501 $mm^2/s$ at 100° C. as a lubricant base oil (A), 2.32% by weight of ethylene/propylene copolymer (B) obtained in Polymerization Example 4 as a viscosity modifier, and 0.50% by weight of Aclube 146 (Sanyo Chemical Industries, Ltd.) as a pour point depressant (C). The results are listed in Table 5.

Example 14

A lubricating oil was similarly prepared and evaluated as in Example 1, except that the lubricating oil comprised 87.18% by weight of a highly dewaxed mineral oil having a low pour point and a kinematic viscosity of 4.863 $mm^2/s$ at 100° C. as a lubricant base oil (A), and 2.82% by weight of ethylene/propylene copolymer (B) obtained in Polymerization Example 4 as a viscosity modifier, and a pour point depressant (C) was not used. The results are listed in Table 5.

TABLE 5

| | Comparative Example 1 | Comparative Example 2 | Comparative Example 3 | Comparative Example 4 Polymer mixed | Comparative Example 5 | Example 13 | Example 14 |
|---|---|---|---|---|---|---|---|
| | Polymerization Example 1 | Polymerization Example 5 | Polymerization Example 6 | Polymerization Example 6 | Polymerization Example 7 | Polymerization Example 4 | Polymerization Example 4 |
| Composition and mixing ratio (% by weight) Within ( ):mixing ratio in (A) (% by weight) | | | | | | | |
| Lubricant base oil (A) | 79.30 | 87.87 | 87.03 | 86.72 | 87.24 | 87.18 | 87.18 |
| (a) Mineral oil having a high viscosity index (VHVI-6) | (40) | (40) | (40) | | (40) | (100) | |
| (b) Mineral oil having a high viscosity index (NEXBASE-3050) | | | | (40) | | | |
| (c) Mineral oil having a low pour point (LP-40) | (60) | (60) | (60) | (60) | (60) | | (100) |
| Ethylene/propylene copolymer (B) | 10.40 | 1.83 | 2.67 | 2.98 | 2.46 | 2.32 | 2.82 |
| Pour point depressant (C) Aclube 146 | 0.30 | 0.30 | 0.30 | 0.30 | 0.50 | | |
| Extreme-pressure agent Anglamol 98A | 10.00 | 10.00 | 10.00 | 10.00 | 10.00 | 10.00 | 10.00 |
| Property of ethylene/propylene copolymer (B) | | | | | | | |
| Ethylene content (mol %) | 78.1 | 78.1 | 60.0 | 60.0 | 86.5 | 78.3 | 78.3 |
| [η] (dl/g) | 0.15 | 1.33 | 0.75 | 0.75 | 0.75 | 0.75 | 0.75 |
| Property of lubricant base oil (A) | | | | | | | |
| Kinematic viscosity (100° C.) ($mm^2/s$) | 5.488 | 5.488 | 5.488 | 4.900 | 5.488 | 6.501 | 4.863 |
| Viscosity index | 110 | 110 | 110 | 104 | 110 | 131 | 85 |
| Pour point (° C.) | −30.0 | −30.0 | −30.0 | −30.0 | −30.0 | −17.6 | −45.0 |
| Cp (% by weight) | 67.3 | 67.3 | 67.3 | 68.5 | 67.3 | 78.1 | 61.5 |
| Performance of oil composition | | | | | | | |
| Kinematic viscosity (100° C.) ($mm^2/s$) | 15.04 | 14.85 | 14.99 | 15.02 | 14.91 | 14.88 | 14.91 |
| Brookfield low-temperature viscosity × $10^3$ (−40° C.) (mpa · s) | 103.4 | 58.9 | 155.4 | 148.9 | 398.0 | 281.5 | 116.2 |

TABLE 5-continued

| | Comparative Example 1 | Comparative Example 2 | Comparative Example 3 | Comparative Example 4 Polymer mixed | Comparative Example 5 | Example 13 | Example 14 |
|---|---|---|---|---|---|---|---|
| | Polymerization Example 1 | Polymerization Example 5 | Polymerization Example 6 | Polymerization Example 6 | Polymerization Example 7 | Polymerization Example 4 | Polymerization Example 4 |
| Shear stability Viscosity reduction rate (%) at KRL test | 6.7 | 49.2 | 42.3 | 43.1 | 30.4 | 32.2 | 34.2 |

Comparative Example 6

A lubricating oil was similarly prepared and evaluated as in Example 7, except that the lubricating oil comprised 87.36% by weight of the oil mixture used in Example 7 as a lubricant base oil (A) and 4.84% by weight of ethylene/propylene copolymer (B) obtained in Polymerization Example 1 as a viscosity modifier. The results are listed in Table 6.

Comparative Example 7

A lubricating oil was similarly prepared and evaluated as in Example 7, except that the lubricating oil comprised 91.25% by weight of the oil mixture used in Example 7 as a lubricant base oil (A) and 0.95% by weight of ethylene/propylene copolymer (B) obtained in Polymerization Example 5 as a viscosity modifier. The results are listed in Table 6.

Comparative Example 8

A lubricating oil was similarly prepared and evaluated as in Example 7, except that the lubricating oil comprised 90.75% by weight of the oil mixture used in Example 7 as a lubricant base oil (A) and 1.45% by weight of ethylene/propylene copolymer (B) obtained in Polymerization Example 6 as a viscosity modifier. The results are listed in Table 6.

Comparative Example 9

A lubricating oil was similarly prepared and evaluated as in Example 10, except that the lubricating oil comprised 90.75% by weight of the oil mixture used in Example 10 as a lubricant base oil (A) and 1.45% by weight of ethylene/propylene copolymer (B) obtained in Polymerization Example 6 as a viscosity modifier. The results are listed in Table 6.

Comparative Example 10

A lubricating oil was similarly prepared and evaluated as in Example 10, except that the lubricating oil comprised 90.87% by weight of the oil mixture used in Example 10 as a lubricant base oil (A) and 1.33% by weight of ethylene/propylene copolymer (B) obtained in Polymerization Example 7 as a viscosity modifier. The results are listed in Table 6.

Example 15

A lubricating oil was similarly prepared and evaluated as in Example 10, except that the lubricating oil comprised 91.07% by weight of mineral oil NEXBASE-3050 (Fortum) having a kinematic viscosity of 4.998 $mm^2/s$ at 100° C. as a lubricant base oil (A), 0.93% by weight of ethylene/propylene copolymer (B) obtained in Polymerization Example 4 as a viscosity modifier, and 0.50% by weight of Aclube 146 (Sanyo Chemical Industries, Ltd.) as a pour point depressant (C). The results are listed in Table 6.

Example 16

A lubricating oil was similarly prepared and evaluated as in Example 10, except that the lubricating oil comprised 90.80% by weight of a highly dewaxed mineral oil having a low pour point (Exxon-Mobil Corporation, LP-35) having a viscosity of 2.826 $mm^2/s$ at 100° C. as a lubricant base oil (A), and 1.7% by weight of ethylene/propylene copolymer (B) obtained in Polymerization Example 4 as a viscosity modifier, and a pour point depressant (C) was not used. The results are listed in Table 6.

TABLE 6

| | Comparative Example 6 | Comparative Example 7 | Comparative Example 8 | Comparative Example 9 Polymer mixed | Comparative Example 10 | Example15 | Example16 |
|---|---|---|---|---|---|---|---|
| | Polymerization Example 1 | Polymerization Example 5 | Polymerization Example 6 | Polymerization Example 6 | Polymerization Example 7 | Polymerization Example 4 | Polymerization Example 4 |
| Composition and mixing ratio (% by weight) Within ( ):mixing ratio in (A) (% by weight) | | | | | | | |
| Lubricant base oil (A) | 87.36 | 91.25 | 90.75 | 90.75 | 90.87 | 91.07 | 90.80 |
| (a) Mineral oil having a high viscosity index (VHVI-6) | (30) | (30) | (30) | | | | |
| (b) Mineral oil having a high | | | | (43) | (43) | (100) | |

TABLE 6-continued

| | Comparative Example 6 | Comparative Example 7 | Comparative Example 8 | Comparative Example 9 Polymer mixed | Comparative Example 10 | Example15 | Example16 |
|---|---|---|---|---|---|---|---|
| | Polymerization Example 1 | Polymerization Example 5 | Polymerization Example 6 | Polymerization Example 6 | Polymerization Example 7 | Polymerization Example 4 | Polymerization Example 4 |
| viscosity index (NEXBASE-3050) | | | | | | | |
| (c) Mineral oil having a low pour point (LP-35) | (70) | (70) | (70) | (57) | (57) | | (100) |
| Ethylene/propylene copolymer (B) | 4.84 | 0.95 | 1.45 | 1.45 | 1.33 | 0.93 | 1.70 |
| Pour point depressant (C) | 0.30 | 0.30 | 0.30 | 0.30 | 0.30 | 0.50 | |
| Aclube 146 | | | | | | | |
| Additive package for automatic transmission oil (LZ-9632F) | 7.50 | 7.50 | 7.50 | 7.50 | 7.50 | 7.50 | 7.50 |
| Property of ethylene/propylene copolymer (B) | | | | | | | |
| Ethylene content (mol %) | 78.1 | 78.1 | 60.0 | 60.0 | 86.5 | 78.3 | 78.3 |
| [η] (dl/g) | 0.15 | 1.33 | 0.75 | 0.75 | 0.75 | 0.75 | 0.75 |
| Property of lubricant base oil (A) | | | | | | | |
| Kinematic viscosity (100° C.) ($mm^2/s$) | 3.647 | 3.647 | 3.647 | 3.630 | 3.630 | 4.988 | 2.824 |
| Viscosity index | 103 | 103 | 103 | 104 | 104 | 125 | 76 |
| Pour point (° C.) | −35.0 | −35.0 | −35.0 | −30.0 | −30.0 | −17.5 | −45.0 |
| Cp (% by weight) | 65.5 | 65.5 | 65.5 | 67.4 | 67.4 | 79.0 | 60.1 |
| Performance of oil composition | | | | | | | |
| Kinematic viscosity (100° C.) ($mm^2/s$) | 7.308 | 7.208 | 7.187 | 7.319 | 7.233 | 7.098 | 7.212 |
| Brookfield low-temperature viscosity (−40° C.) (mpa · s) | 23670 | 13450 | 21550 | 22300 | $234.6 \times 10^3$ | 25400 | 14800 |
| Shear stability Viscosity reduction rate (%) at JASO-SONIC test | 1.1 | 19.8 | 19.3 | 19.6 | 7.1 | 7.8 | 9.7 |

The invention claimed is:

1. A lubricating oil composition for a power transmission system, comprising:

a mineral oil type lubricant base oil (A) having the following properties (A0-1) to (A0-3):

(A0-1) a kinematic viscosity at 100° C. in the range of 2 to 10 $mm^2/s$, (A0-2) a viscosity index not less than 90, and (A0-3) a pour point not higher than −20° C., and 0.1 to 10% by weight of an ethylene/propylene copolymer (B) having the following properties (B1) to (B4):

(B1) an ethylene content in the range of 78.0 to 85% by mol., (B2) an intrinsic viscosity [η] in the range of 0.2 to 0.75 dl/g, (B3) Mw/Mn not more than 2.4, and (B4) a melting point, as measured by DSC, not higher than 60° C., or no melting point is observed.

2. The lubricating oil composition for a power transmission system as claimed in claim 1, wherein the mineral oil type lubricant base oil (A) comprises:

20 to 60% by weight of a mineral oil (AI) having the following properties (AI-1) to (AI-3):

(AI-1) a kinematic viscosity at 100° C. in the range of 2 to 10 $mm^2/s$, (AI-2) a viscosity index not less than 110, and (AI-3) a pour point not higher than −10° C., and 40 to 80% by weight of a mineral oil (AII) having the following properties (AII-1) to (AII-3):

(AII-1) a kinematic viscosity at 100° C. in the range of 2 to 10 $mm^2/s$, (AII-2) a viscosity index not less than 70, and (AII-3) a pour point not higher than −35° C.

wherein the mineral oils (AI) and (AII) equal 100%, and a mineral oil other than the mineral oils (AI) and (AII) may optionally be contained in an amount of 10 parts by weight or lower relative to the total 100 parts by weight of the mineral oil type lubricant base oil (A).

3. The lubricating oil composition for a power transmission system as claimed in claim 1, wherein the mineral oil type lubricant base oil (A) has a Cp value, as defined by ASTM D3228, of less than 70%.

4. A lubricating oil composition for a power transmission system, comprising:

a mineral oil type lubricant base oil (A), 0.1 to 10% by weight of an ethylene/propylene copolymer (B) having the following properties (B1) to (B4):

(B1) an ethylene content in the range of 78.0 to 85% by mol., (B2) an intrinsic viscosity [η] in the range of 0.2 to 0.75 dl/g, (B3) Mw/Mn not more than 2.4, and (B4) a melting point, as measured by DSC, not higher than 60° C., or no melting point is observed, and 3 to 20% by weight of a polymethacrylate type viscosity modifier.

5. The lubricating oil composition for a power transmission system as claimed in claim 4, wherein the mineral oil type lubricant base oil (A) has the following properties:

(A0-1) a kinematic viscosity at 100° C. in the range of 2 to 10 $mm^2/s$, (A0-2) a viscosity index not less than 90, and (A0-3) a pour point not higher than −20° C.

* * * * *